US007845756B2

(12) United States Patent
Muraoka

(10) Patent No.: US 7,845,756 B2
(45) Date of Patent: Dec. 7, 2010

(54) INKJET RECORDING APPARATUS AND METHOD OF CONTROLLING THE APPARATUS

(75) Inventor: Chiaki Muraoka, Kawaguchi (JP)

(73) Assignee: Canon Kabushiki Kaisha, Tokyo (JP)

( * ) Notice: Subject to any disclaimer, the term of this patent is extended or adjusted under 35 U.S.C. 154(b) by 187 days.

(21) Appl. No.: 12/192,332

(22) Filed: Aug. 15, 2008

(65) Prior Publication Data

US 2009/0046123 A1 Feb. 19, 2009

(30) Foreign Application Priority Data

Aug. 17, 2007 (JP) ..... 2007-213157

(51) Int. Cl.
*B41J 2/165* (2006.01)

(52) U.S. Cl. ..... 347/23; 347/33; 347/28; 347/32

(58) Field of Classification Search ..... 347/33, 347/28, 23, 32
See application file for complete search history.

(56) References Cited

U.S. PATENT DOCUMENTS 5,905,514 A 5/1999 Rhoads
6,637,855 B2 * 10/2003 Ide et al. ..... 347/23

* cited by examiner

*Primary Examiner*—Shih-wen Hsieh
(74) *Attorney, Agent, or Firm*—Canon USA Inc IP Division

(57) ABSTRACT

Wiping is performed every time when a predetermined period elapses. With the wiping performed step by step, a density of ink in liquid remaining on a discharge port surface is diluted, and becomes a predetermined density or lower. Accordingly, a condition can be maintained, in which the ink can be reliably discharged from a recording head when a recording operation is newly started, although the wiping is not additionally performed after the above wiping. In this case, even when the recording operation is started again or the recording operation is newly started after the several wiping operations, an amount of cleaning liquid used in the several times of wiping is proper to an intermission period. Thus, the cleaning liquid can be prevented from being wastefully consumed.

12 Claims, 6 Drawing Sheets

INKJET RECORDING APPARATUS AND METHOD OF CONTROLLING THE APPARATUS

BACKGROUND OF THE INVENTION

1. Field of the Invention

The present invention relates to an inkjet recording apparatus and a method of controlling the apparatus, and more particularly to control of wiping performed while cleaning liquid is supplied to a discharge port surface of a recording head.

2. Description of the Related Art

An inkjet recording apparatus that forms an image by applying ink from discharge ports of a recording head onto a recording medium is a low-noise, non-impact recording apparatus. The recording apparatus has various advantages such as an ability of performing a recording operation with a high density at a high speed. However, the ink is discharged from extremely small discharge ports, and hence, extremely small ink droplets (mist) may be generated in addition to expected ink droplets. Also, discharged ink droplets are bounced, and hence, extremely small ink droplets may be generated. Such ink droplets (hereinafter, also referred to as contamination ink) may adhere to the discharge port surface of the recording head, which may disturb desired ink discharge. In light of the above situations, a typical inkjet recording apparatus employs a configuration that wipes off a discharge port surface of a recording head with a member such as a blade to remove contamination ink.

However, a currently available inkjet printer or the like tends to use ink having a high image fastness to increase a water-resistant property and a weather-resistant property of a recorded image. Hence, a simple wiping mechanism, such as one described above using the blade, may insufficiently remove the contamination ink. This is because an adhering force of the contamination ink to the discharge port surface of the recording head is increased as a result of the use of the ink having the high image fastness. As described above, a coloring material having a good fixing property to a recording medium is easily fixed to the discharge port surface of the recording head. Such a coloring material may have a contradiction such that when the image fastness is increased, the ink discharging performance is decreased.

U.S. Pat. No. 5,905,514 discloses a configuration as one of solutions for the problems. In particular, predetermined processing liquid (cleaning liquid) is supplied to a discharge port surface of a recording head via a blade (wiper), to dissolve contamination ink on the discharge port surface with the cleaning liquid, and to wipe off and remove the dissolved contamination ink. With the configuration disclosed in U.S. Pat. No. 5,905,514, the following advantages are expected to be provided. (1) A frictional resistance between the discharge port surface and the blade can be reduced when the discharge port surface is wiped off, thereby reducing wearing and deterioration of the discharge port surface. (2) The dried contamination ink on the discharge port surface can be dissolved. (3) The contamination ink on the discharge port surface can be easily moved. (4) A thin film of cleaning liquid can be formed on the discharge port surface.

With the above configuration, the ink discharging performance can be maintained in a good condition when recording with the recording head and cleaning of the discharge port surface are periodically performed at a relatively short interval.

However, when an intermission period of a recording operation is a long period, the contamination ink may be thickened on and fixed to the discharge port surface. Hence, the ink discharging performance may become defective and would not be recovered. The contamination ink is thickened on and fixed to the discharge port surface due to the following factors. The thin film of the cleaning liquid is not uniformly formed on the discharge port surface. Hence, when the contamination ink adheres to a portion without the cleaning liquid and is left for a long period, the contamination ink gradually becomes difficult to be dissolved. Also, when ink, which has been dissolved once with the cleaning liquid, is left on the discharge port surface for a long period, a part of an ink component may be separated and fixed to the discharge port surface.

In contrast, when a density of an ink component in liquid such as the contamination ink remaining on the discharge port surface is a predetermined density or lower, the ink discharge would not become defective although a long period elapses without a wiping operation with the blade. That is, although the recording apparatus is left without the wiping, the ink component can be removed from the discharge port surface. Accordingly, when the intermission period of the recording operation becomes long, the density of the ink component in the liquid remaining on the discharge port surface may be diluted to a predetermined density or lower. Then, it is considerable that when the recording operation enters the intermission period, cleaning is performed with an increased supplying amount of the cleaning liquid to the discharge port surface, so that the density of the ink component becomes the predetermined density or lower by a single supplement of the cleaning liquid. However, if the recording operation is activated in a short time after the cleaning, the amount of the cleaning liquid used in the cleaning may be excessive. This configuration may increase a consumption amount of the cleaning liquid. Also, when dilution progresses step by step through a plurality of times of the cleaning, dilution unevenness within the discharge port surface can be reduced as compared with the case where the larger amount of the cleaning liquid is supplied by a single cleaning operation to provide an equivalent dilution. Further, a large consumption of the cleaning liquid may cause the following problems. In particular, a total amount of the cleaning liquid to be housed in the recording apparatus may be increased, the cleaning liquid may be scattered during the wiping operation, and an amount of contamination liquid to be collected from the discharge port surface may be increased.

SUMMARY OF THE INVENTION

The present invention provides an inkjet recording apparatus capable of reducing a consumption amount of cleaning liquid as much as possible when a discharge port surface of a recording head is cleaned up with the cleaning liquid, and securing ink discharge performance for a long period, and provides a method of controlling the apparatus.

An inkjet recording apparatus according to an aspect of the present invention is configured to perform recording by discharging ink from a recording head. The apparatus includes a wiping unit configured to perform wiping by bringing a blade into contact with a discharge port surface of the recording head; a cleaning liquid applying unit configured to apply cleaning liquid to the blade, the cleaning liquid cleaning up the discharge port surface of the recording head; a measurement unit configured to measure an intermission period of a recording operation; and a control unit configured to control the wiping unit so as to perform the wiping while the cleaning liquid is supplied to the discharge port surface with the blade to which the cleaning liquid is applied by the cleaning liquid applying unit, when the intermission period measured by the measuring unit is a predetermined period or longer. The cleaning liquid is supplied to the discharge port surface through the wiping by an amount that causes a density of an ink component in liquid adhering on the discharge port surface through the recording operation to be a predetermined density or lower.

Further features of the present invention will become apparent from the following description of exemplary embodiments with reference to the attached drawings.

DESCRIPTION OF THE EMBODIMENTS

Embodiments of the present invention are described below with reference to the attached drawings.

Figure 1:
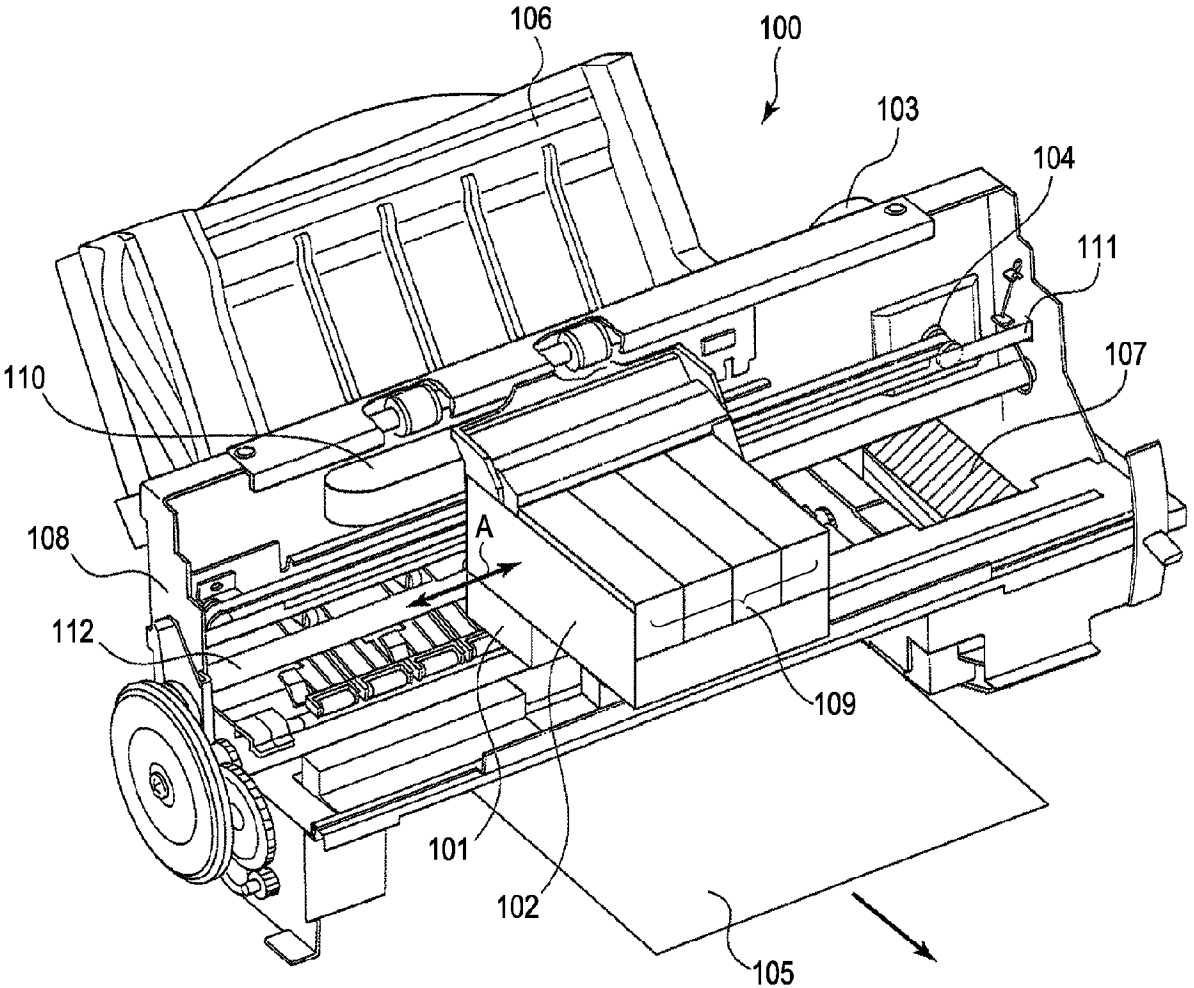
FIG. 1 is a perspective view schematically showing an inkjet recording apparatus according to an embodiment of the present invention.

FIG. 1 is a perspective view schematically showing an inkjet recording apparatus according to an embodiment of the present invention. Referring to FIG. 1, an inkjet recording apparatus 100 includes a recording head 101 that has nozzles (discharge ports) for discharging ink, and a carriage 102 that carries and moves the recording head 101. Also, the inkjet recording apparatus 100 includes a carriage guide 112, a driving motor 103, and a driving force transmitting mechanism 104, to move the carriage 102 in a reciprocating manner in a direction indicated by arrow A in the drawing. Further, the inkjet recording apparatus 100 includes a feeding mechanism 106 that feeds a recording medium 105 to a region in which ink is discharged from the recording head 101, and a maintenance unit 107 that maintains and recovers an ink discharging performance of the recording head 101. The components of the inkjet recording apparatus 100 are mounted to a chassis 108 that defines a main body of the inkjet recording apparatus 100.

In the inkjet recording apparatus 100, the recording head 101 is driven at a predetermined timing while the carriage 102 is moved, and ink is discharged in accordance with recording data on the recording medium 105 that is fed from the feeding mechanism 106. The recording medium 105 is conveyed by a predetermined amount in association with scanning with the recording head 101 by the movement of the carriage 102. Hence, recording can be performed for the entire recording medium 105. The maintenance unit 107 is provided outside a recording region. When a maintenance operation for the recording head 101 is to be performed, the carriage 102 is moved to the position of the maintenance unit 107. The maintenance unit 107 performs maintenance operations, such as cleaning of an ink discharging surface of the recording head 101, discharge of defective ink in the nozzles, and removal of bubbles and dust entering the nozzles by suction.

Figure 2:
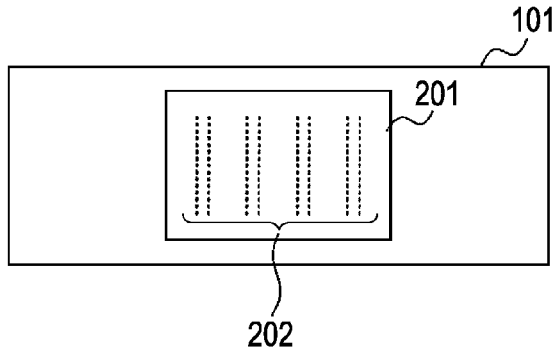
FIG. 2 is an illustration showing a discharge port surface of a recording head shown in FIG. 1.

FIG. 2 is an illustration showing the discharge port surface of the recording head 101. As illustrated, ink is discharged from each of a plurality of nozzles 202 provided in a discharge port surface 201, in accordance with recording data. A heater is provided in each of the nozzles 202. When the heater rapidly generates heat, the heat causes film boiling to occur in ink in the nozzle. A force of bubbles resulted from the film boiling is used to discharge the ink from the nozzle. For example, an element that generates discharge energy may be a piezo element. In this case, a part of an ink flow path or a part of an ink reservoir is made of a piezo element. The ink can be discharged from the nozzle by deforming the piezo element with a predetermined electric signal. The electric signal necessary for driving the heater provided in the recording head 101 is supplied from a control board (not shown) of the main body to the carriage 102 via a flexible cable 110, and then is transmitted to the recording head 101. Also, ink tanks 109 that supply recording ink to the recording head 101 are attachable to and detachable from the recording head 101 in a replaceable manner.

The ink discharged from the nozzle flies in the air in a single droplet form, or in a plurality of separated droplets. When the ink is discharged at a typical discharge rate (about 10 to 20 m/s), the ink is generally separated into a plurality of droplets. When leading droplets from among the plurality of separated droplets are called main droplets, and residual following droplets are called satellite droplets, the main droplets tend to be larger than the satellite droplets. Smaller droplets from among the satellite droplets may be blown by air flow caused by, for example, the moving recording head 101, and may adhere to the discharge port surface. The discharge port surface typically has an ink-shedding property. Hence, ink droplets, which are aggregated due to an interfacial tension, are accumulated on the discharge port surface as the ink discharge is continued.

An absolute position of the carriage 102 in a moving direction can be acquired with a code strip 111. A linear encoder (not shown) is mounted in the carriage 102. The code strip 111 has black bars printed thereon at a predetermined interval. The linear encoder reads one of the black bars, so as to accurately acquire the position of the carriage 102. Also, a reference position is provided in a movement path of the carriage 102. The reference position is used to initialize the absolute position. There may be a method in which the carriage 102 is physically brought into contact with a given member to determine the position of the carriage 102, or a method in which a predetermined pattern is printed on the code strip 111 and is read to determine the position.

Figure 3:
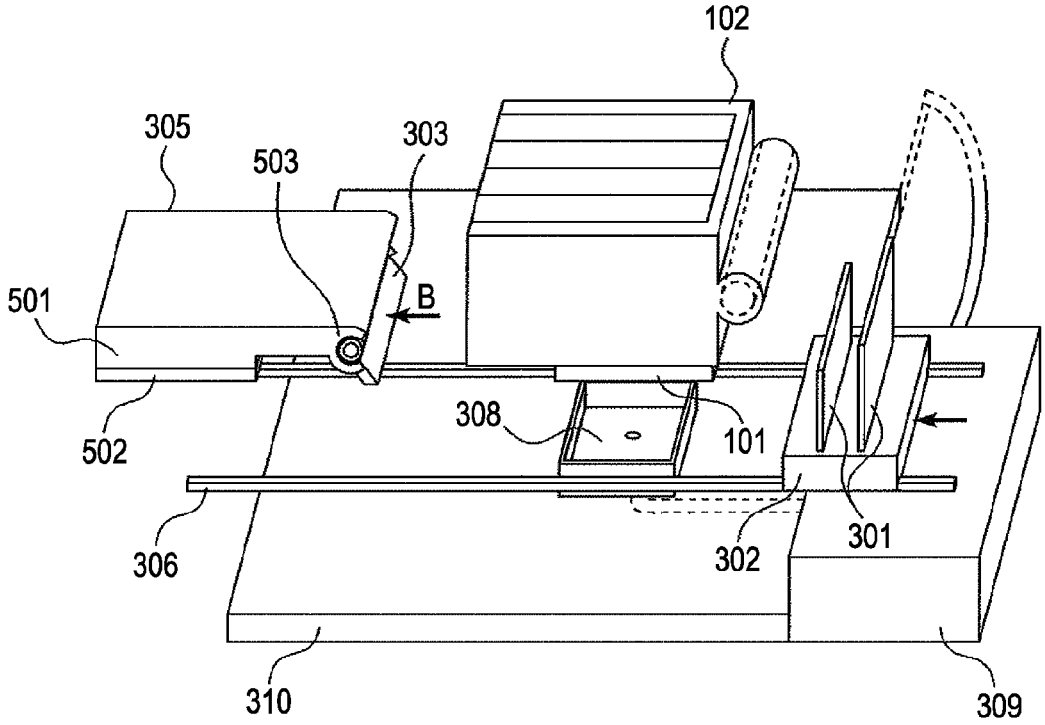
FIG. 3 is a perspective view schematically showing a detailed configuration of a maintenance unit shown in FIG. 1.

FIG. 3 is a perspective view schematically showing a detailed configuration of the maintenance unit 107. The maintenance unit 107 includes a cap 308 that covers the entire discharge port surface of the recording head 101 to protect the recording head 101 (capping). The cap 308 is connected to a suction unit 309. The suction unit 309 is connected to a waste ink absorbing member 310. Further, the maintenance unit 107 includes a blade 301 that wipes off and cleans up the discharge port surface of the recording head 101, and a blade cleaner 303 that cleans up the blade 301 (wiping). A cleaning liquid supply unit 305 stores cleaning liquid therein and applies the cleaning liquid to the blade 301. The cap 308 is vertically moved to perform the capping. Also, the blade 301 is horizontally moved in the drawing to perform the wiping. The cap 308 and the blade 301 are moved with a maintenance motor (not shown) as a drive source.

The cap 308 covers the entire discharge ports provided at the discharge port surface of the recording head 101 (capping). With the capping, the recording head 101 can be protected from physical damage, and the ink in the nozzles can be prevented from being thickened or dried, so as to prevent the discharge ports from being clogged. When the recording operation of the recording head 101 is intermitted for a predetermined time or longer, the recording head 101 is protected in a capped condition. In addition, when the recording head 101 is in the capped condition, the ink can be forcibly discharged from the discharge ports of the recording head 101 by suction with the suction unit 309. With the suction, air bubbles remaining in an ink supply system, thickened ink, dust, and the like, are discharged together with the ink. Thus, the ink discharging performance of the recording head 101 can be maintained or recovered. The waste ink sucked by the suction unit 309 is finally discharged to the waste ink absorbing member 310.

The blade 301 wipes off and removes ink droplets, paper dust, and the like, which adhere to the discharge port surface of the recording head 101. The blade 301 is made of an elastic material. In this embodiment, two blades 301 are provided on a blade holder 302. The blade holder 302 is moved by a moving mechanism (not shown) in a reciprocating manner on a blade holder guide 306. With the movement of the blade holder 302, the blades 301 contact the discharge port surface 201, and wipe off and clean up the discharge port surface 201 (wiping). After the wiping, mixed liquid of the ink and the cleaning liquid that promotes a lubricity during the wiping remains as a residue.

The blade cleaner 303 and the cleaning liquid supply unit 305 are disposed in a path in which the blades 301 are moved. A cleaning liquid supply port 502 is provided at the cleaning liquid supply unit 305. The blades 301 can reach the cleaning liquid supply port 502 via the blade cleaner 303. The blade cleaner 303 is assembled with the cleaning liquid supply unit 305, and cleans up the blades 301 immediately before the blades 301 are advanced to the cleaning liquid supply port 502. The blade cleaner 303 removes and collects contamination liquid (mixed liquid of the cleaning liquid and the ink wiped off from the discharge port surface of the recording head 101) adhering to the blades 301. When the blade cleaner 303 comes into contact with the blades 301 in a direction indicated by arrow B in the drawing, the blade cleaner 303 stops at a predetermined position and contacts the blades 301 with a strong force, so as to efficiently wipe off the contamination liquid. When the blade cleaner 303 come into contact with the blades 301 in the opposite direction, the blade cleaner 303 is rotated and retracted around a joint portion at which the blade cleaner 303 is mounted to a supporting portion 503, so as to reduce a contact force of the blades 301. After the blades 301 pass the blade cleaner 303, the rotated blade cleaner 303 is automatically restored to the initial stop position. The above configuration may use the weight of the blade cleaner 303, or a spring member (not shown) to bias the blade cleaner 303 in advance in a direction opposite to the rotation direction thereof.

The cleaning liquid is supplied from the cleaning liquid supply unit 305 to the blades 301 which have been cleaned up by the blade cleaner 303. The cleaning liquid has a characteristic capable of easily dissolving or dispersing an ink component on the recording head 101. Also, the cleaning liquid contains a low-volatile component, and accordingly, the cleaning liquid can prevent the ink component wiped off with the blades 301 from being dried and losing fluidity. The cleaning liquid also functions as a lubricant to reduce a frictional resistance between the discharge port surface of the recording head 101 and the blades 301. Thus, the cleaning liquid can reduce wearing of the discharge port surface. The cleaning liquid may be, for example, a glycerin solution. The cleaning liquid supply unit 305 has the supporting portion 503 at an entrance portion to which the blades 301 are advanced. The supporting portion 503 supports the blade cleaner 303. Also, the cleaning liquid supply unit 305 includes therein a reservoir portion 501 of the cleaning liquid, and the cleaning liquid supply port 502 coupled with the reservoir portion 501. The cleaning liquid supply port 502 is made of a porous member that holds the cleaning liquid by a capillary force. When the blades 301 contact the cleaning liquid supply port 502, the meniscus of the cleaning liquid held with the porous member is disrupted, and the exiting cleaning liquid is transferred onto the blades 301. The reservoir portion 501 houses the cleaning liquid in a porous member having a smaller capillary force than that of the cleaning liquid supply port 502, or merely in a space. The reservoir portion 501 can supply the cleaning liquid to the cleaning liquid supply port 502.

A supplying amount of the cleaning liquid to the blades 301 is increased as a time in which the blades 301 contact the cleaning liquid supply port 502 is increased. Alternatively, another mechanism that changes the supplying amount of the cleaning liquid may be may be employed, in which a heating mechanism (not shown) is provided at the reservoir portion 501 or the cleaning liquid supply port 502, and the cleaning liquid is heated with the heating mechanism, to increase the fluidity of the cleaning liquid. Thus, the supplying amount of the cleaning liquid can be increased. Still alternatively, the blades 301 may be inhibited from reaching the cleaning liquid supply port 502, so as to intentionally inhibit the cleaning liquid from being supplied. In this case, the blades 301 are cleaned up only with the blade cleaner 303. Hence, next wiping can be performed with the blades 301 to which substantially no liquid adheres. That is, at least in a condition immediately after all the blades 301 pass the blade cleaner 303, the blades 301 and the cleaning liquid supply port 502 are configured so as not to contact each other. In particular, a distance between the two blades 301 is set shorter than a distance between the blade cleaner 303 and the cleaning liquid supply port 502.

Figure 4:
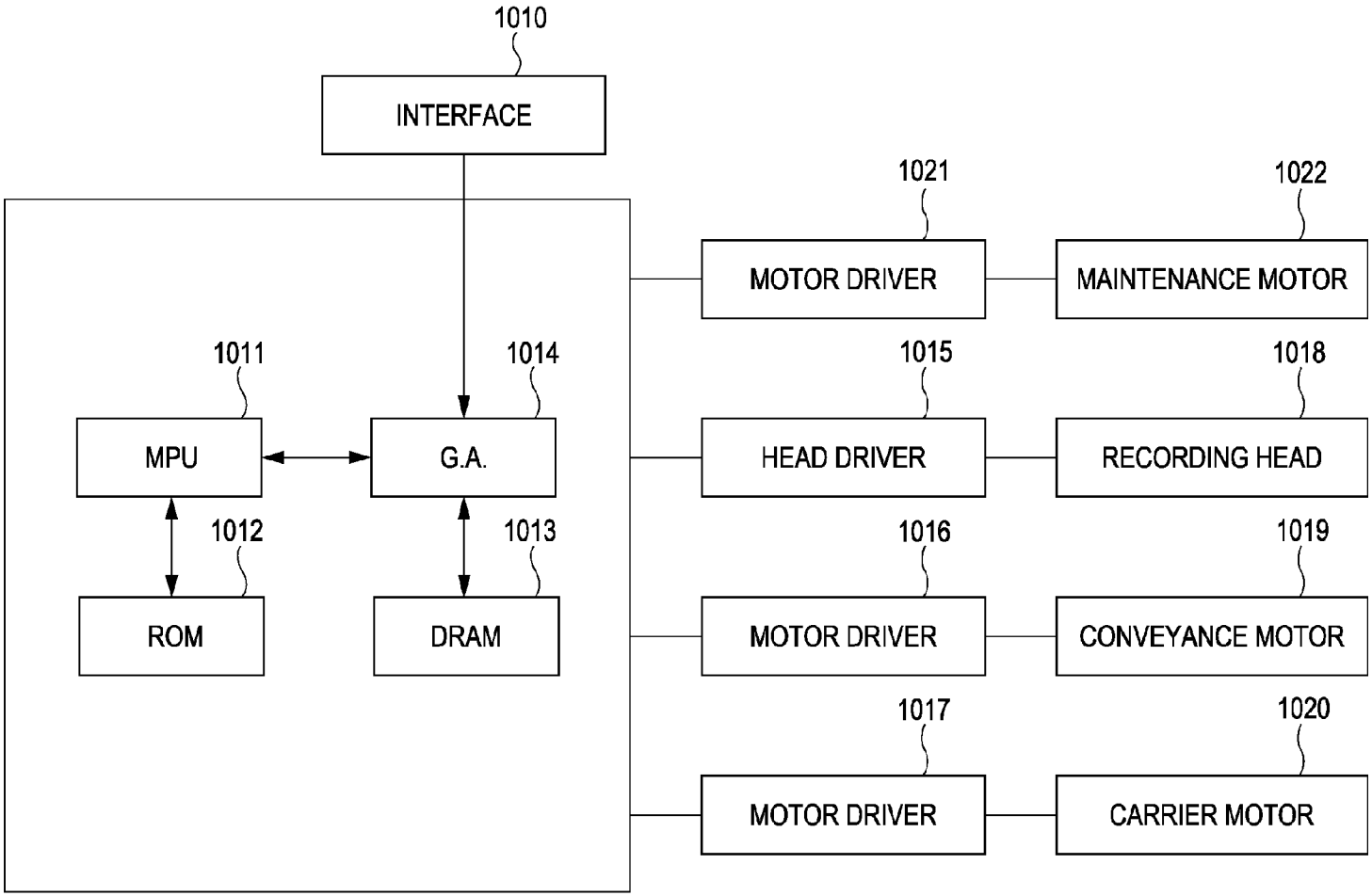
FIG. 4 is a block diagram showing a control configuration of the inkjet recording apparatus shown in FIG. 1.

FIG. 4 is a block diagram showing a control configuration of the inkjet recording apparatus according to this embodiment.

Referring to FIG. 4, reference numeral 1010 denotes an interface for transmission and reception of a recording signal and the like between the inkjet recording apparatus and a host apparatus, and 1011 denotes a MPU. Reference numeral 1012 denotes a program ROM, and 1013 denotes a dynamic RAM. The ROM 1012 stores a control program, which will be described later with reference to FIGS. 5, 6, and other figures. The MPU 1011 executes the control program. Also, the RAM 1013 stores various data (the recording signal, recording data supplied to a recording head, and the like). The RAM 1013 can also store the number of recording dots, the number of replacements of a head cartridge, and the like. Reference numeral 1014 denotes a gate array that controls supplement of the recording data to the recording head 1018. The gate array 1014 also controls transmission of data among the interface 1010, the MPU 1011, and the RAM 1013. Reference numeral 1020 is a carrier motor serving as a drive source for movement of a recording head 1018, and 1019 denotes a conveyance motor serving as a drive source for conveyance of a recording sheet. Reference numeral 1022 denotes a maintenance motor serving as a drive source for movement of the blades 301 and the cap 308 in the maintenance unit 107. Reference numeral 1015 denotes a head driver that drives the recording head 1018 in accordance with the recording data to cause ink to be discharged. Reference numerals 1016 and 1017 respectively denote motor drivers for driving the conveyance motor 1019 and the carrier motor 1020. In addition, reference numeral 1021 denotes a driver for driving the maintenance motor 1022 under the control executed by the MPU 1011.

In the control configuration shown in FIG. 4, when a recording signal is input to the interface 1010, processing for converting the recording signal into recording data for printing is performed between the gate array 1014 and the MPU 1011. Also, the driving of the motors 1019, 1020, and 1022 are controlled respectively via the motor drivers 1016, 1017, and 1021. At the same time, the recording head (portion) 1018 is driven in accordance with the recording data of respective colors transmitted to the head driver 1015, and a recording operation is performed. Also, a timer (not shown) measures an intermission period of the recording operation, which will be described later.

A maintenance operation in an intermission period of a recording operation is described below according to several embodiments, based on the inkjet recording apparatus of the above-described embodiment.

First Embodiment

Figure 5:
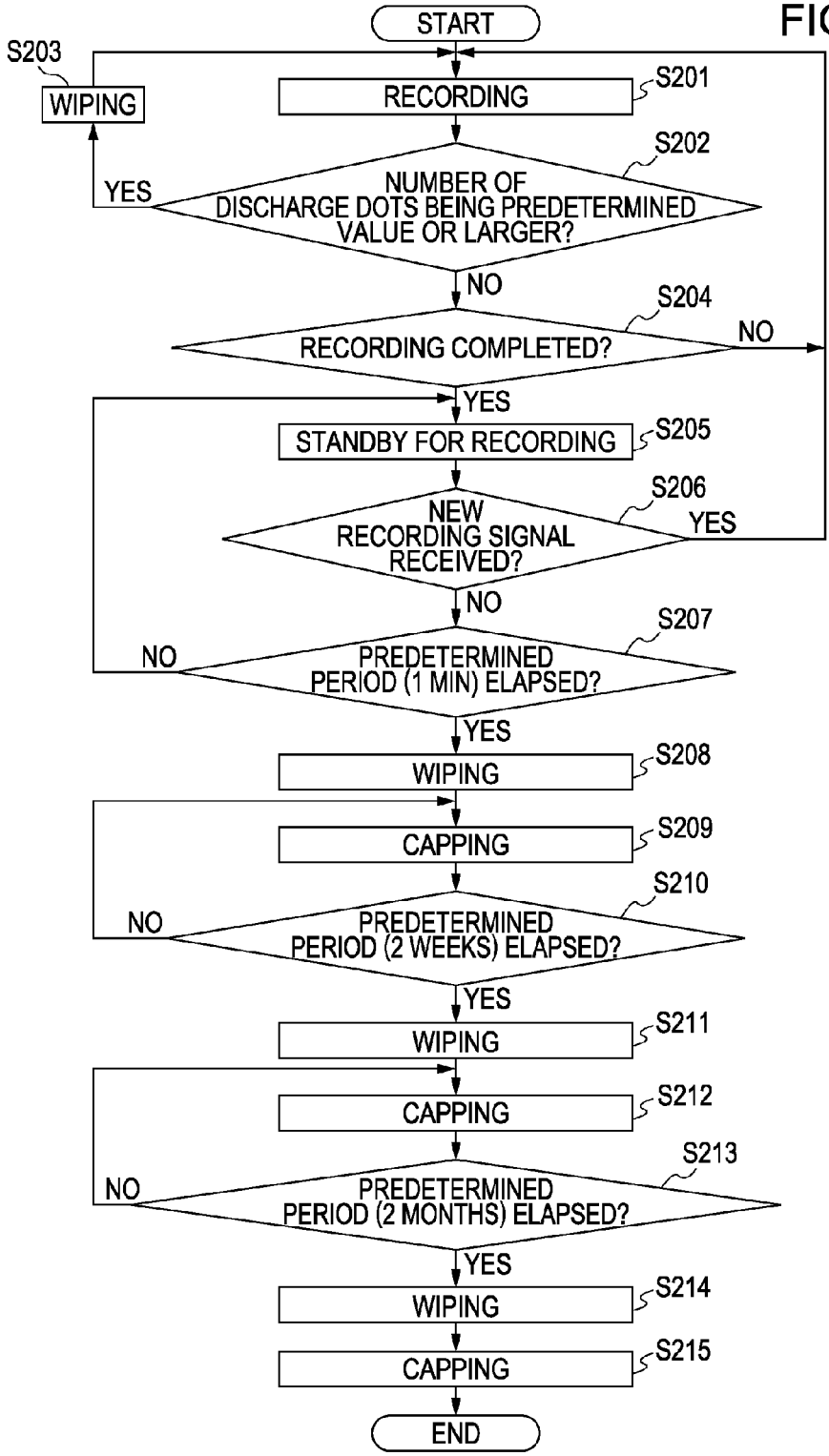
FIG. 5 is a flowchart particularly showing a maintenance operation during an intermission of a recording operation according to a first embodiment of the present invention.

FIG. 5 is a flowchart particularly showing a maintenance operation during an intermission of a recording operation according to a first embodiment of the present invention.

A recording apparatus according to this embodiment performs recording by discharging ink from the recording head onto a recording medium in accordance with recording data transmitted from the host apparatus (S201). At this time, as described above, a portion of the satellite droplets of the ink generated when the ink is discharged adheres to the discharge port surface, and is accumulated as the recording operation progresses. The recording apparatus of this embodiment counts the number of discharges (the number of discharge dots) from the recording head. When the recording apparatus detects that a total value has reached a certain number (S202), the recording apparatus performs wiping with the blades 301 to clean up the discharge port surface (S203). This process prevents the ink accumulated on the discharge port surface from becoming a predetermined amount or more. If the ink is accumulated on the discharge port surface, for example, the following problems may occur. The ink accumulated on the discharge port surface may fall onto the recording medium, and may contaminate a recorded image. Also, ink droplets provided on the discharge port surface may clog the discharge ports, or may be combined with ink that is discharged immediately after the discharge is started, thereby causing defective discharge or destabilizing a discharging direction. When the wiping is performed using the blades with the cleaning liquid supplied, the frictional resistance between the discharge port surface and the blades can be reduced, and the ink at the interface between the discharge port surface and the blades can be dissolved and wiped out. If the supplement of the cleaning liquid to the blades is not necessary, the blades cleaned up only with the blade cleaner may be used for wiping. Since the cleaning liquid is not supplied, the cleaning liquid can be saved, and the amount of the cleaning liquid remaining on the discharge port surface can become extremely small. In order to further reduce an intermission time of the recording operation, the wiping may be completed by a single wiping operation. When ink of unexpected color is mixed into the nozzles after the wiping, the mixed ink is discharged, and then, the recording is started again. The above-described recording and operations associated therewith (S201 to S203) are repeated until all recording is completed in accordance with the recording data. When the recording is completed (S204), the process goes to step S205.

In step S205, the recording head is in a standby condition at a home position in preparation for a case where recording data is received and recording start is instructed, in a short time after the recording is completed. In the standby condition, a small amount of ink is intermittently discharged, to prevent the ink inside the discharge ports from being fixed, so that the process shifts to the recording operation immediately after the recording data is received. In the standby condition, the number of discharge dots is continuously counted. A cumulative count is calculated by adding the numbers of discharge dots since the previous recording operation is completed.

In the recording standby condition, it is determined whether new recording data is transferred or not (S206). If the new recording data is transferred, the process immediately shifts to the recording operation (S201) Also, in the recording standby condition, it is determined whether or not a first predetermined period or longer has elapsed after the last recording operation (S207). If the predetermined period has not elapsed, the recording standby condition is continued. In contrast, if the predetermined period has elapsed, the recording operation enters the intermission period. In this embodiment, it is assumed that the predetermined period is one minute.

In the intermission period of the recording operation, in step S208, the ink adhering to and accumulated on the discharge port surface as a result of the ink discharge during the recording standby condition is removed by wiping. After the wiping, liquid containing the ink remains on the discharge port surface. Herein, when ink of unexpected color is mixed into the nozzles through the wiping, the mixed ink is discharged. When the discharge is to be performed, a driving condition of the recording head is changed to prevent new ink from adhering to the discharge port surface through the discharge. For example, the discharge frequency (the number of discharges per one second) or the number of nozzles which discharge ink at the same time may be reduced. Accordingly, a temperature increase in the recording head can be substantially restricted. Thus, discharging, which reduces satellite droplets, can be performed. Thus, the ink adhesion to the discharge port surface can be restricted.

Next, in step S209, capping is performed with the cap to prevent the inside of the nozzles and the discharge port surface from being dried. However, if the capped condition is left for a long period, the ink component is further fixed onto the discharge port surface, which may affect the recording quality. Therefore, if the recording operation is not performed although a predetermined period has elapsed, a dilution operation is performed for the ink component remaining on the discharge port surface.

That is, it is determined whether a second predetermined period has elapsed or not in step S210. If the second predetermined period has elapsed, in step S211, wiping of the discharge port surface is performed while the cleaning liquid is adheres to the blades 301. Accordingly, the cleaning liquid is supplied to the discharge port surface, so as to dilute the liquid remaining on the discharge port surface, and to prevent the liquid from being thickened. The second predetermined period may be set with regard to, for example, an average frequency of the recording operation by a user, and a fixing rate of the ink component in the residue liquid on the discharge port surface. For example, the second predetermined period is two weeks in this embodiment. In step S212, capping is performed with the cap to prevent the inside of the discharge ports and the discharge port surface from being dried. In this embodiment, even in the condition after the wiping is performed two times, the ink component may be still further fixed onto the discharge port surface, which may affect the recording quality. Therefore, if the recording operation is not performed although a predetermined period has elapsed, a dilution operation is performed.

That is, it is determined whether a third predetermined period has elapsed or not in step S213. If the third predetermined period has elapsed, in step S214, wiping of the discharge port surface is performed while the cleaning liquid adheres to the blades 301. Accordingly, the cleaning liquid is supplied to the discharge port surface, so as to dilute the liquid remaining on the discharge port surface, and to prevent the liquid from being thickened. The third predetermined period is also set with regard to, for example, the frequency of the recording operation by the user, and the fixing rate of the ink component in the residue liquid on the discharge port surface. In this embodiment, the third predetermined period if two months since the last recording operation is completed. After the wiping, capping is performed (S215) to prevent the inside of the discharge ports and the discharge port surface from being dried.

In this embodiment, since the wiping is performed three times, the ink contained in the liquid remaining on the discharge port surface is diluted, and hence, the density of the ink becomes a predetermined density or lower. Also, density distribution of the ink on the discharge port surface becomes close to a uniform state step by step. Accordingly, a condition can be maintained, in which ink can be reliably discharged from the recording head when the recording operation is newly started, although the wiping is not additionally performed after the wiping is performed three times. That is, even when the recording apparatus is left without the wiping, the ink component can be removed from the discharge port surface. In this case, even when the recording operation is started again or the recording operation is newly started after the several wiping operations, the amount of the cleaning liquid used in the several times of wiping is proper to the intermission period. Thus, the cleaning liquid can be prevented from being wastefully consumed.

When an instruction signal to turn off a power (interruption of power supply) of the recording apparatus is received in any of steps S201 to S215, in this embodiment, the power of the apparatus is controlled to be turned off after the operations to step S215 are completed. Accordingly, the power of the recording apparatus can be turned off after the density of the ink in the liquid remaining on the discharge port surface becomes a predetermined density or lower by the three wiping operations. Thus, even when the power-off period of the recording apparatus is relatively long, the discharge port surface can be maintained in a good condition without defective discharge during recording.

Alternatively, instead of the dilution operations in steps S208, S211, and S214, similar processing may be performed by supplying a larger amount of cleaning liquid by a single wiping operation. Accordingly, a time necessary for completion of power-off can be further reduced. If required power supply is always available in the power-off state of the recording apparatus, the above control does not have to be performed.

In this embodiment, while the wiping is performed three times for the dilution, to reduce the density of the ink component remaining on the discharge port surface to a predetermined value or smaller, the number of wiping operations is not limited to three. The dilution may be performed at a shorter time interval with multiple steps. In this case, the supplying amount of the cleaning liquid every wiping operation should be smaller than that in an example shown in FIG. 6, which will be described later.

An example of the supplying amount of the cleaning liquid to the discharge port surface according to this embodiment is shown in Table 1. Ink was made of a coloring material containing a pigment component. Cleaning liquid was a solution containing glycerin by 80% at normal temperature. It is assumed that, in the recording apparatus in FIG. 1, the supplying amount of the cleaning liquid is a total of application amounts of the cleaning liquid applied from the cleaning liquid supply unit to the two blades through a single contact. A measurement method of a supplying amount of the cleaning liquid at a time employed a method in which wiping was performed a plurality of times (desirably, greater number of times), a change in a weight of the reserved cleaning liquid was divided by the number of the cleaning liquid supplying operations to obtain an average value. Environmental conditions were normal temperature and normal humidity.

The three wiping operations in this embodiment includes a first wiping mode which is wiping for the shortest, first predetermined period, and a second wiping mode which is wiping for the second and third predetermined periods. The amount of the cleaning liquid to be supplied onto the discharge port surface in the second wiping mode is larger than that of the first wiping mode. In this case, the second wiping mode is a mode in which the wiping is repeated a plurality of times using the blades with the cleaning liquid applied.

TABLE 1

| Step | Period elapsed after completion of recording | Supplying amount of cleaning liquid for single wiping operation | Total supplying amount of cleaning liquid |
|---|---|---|---|
| S207 | 1 minute | 0.3 mg | 0.3 mg |
| S210 | 2 weeks | 0.3 mg | 0.6 mg |
| S213 | 2 months | 0.4 mg | 1.0 mg |

Second Embodiment

Figure 6:
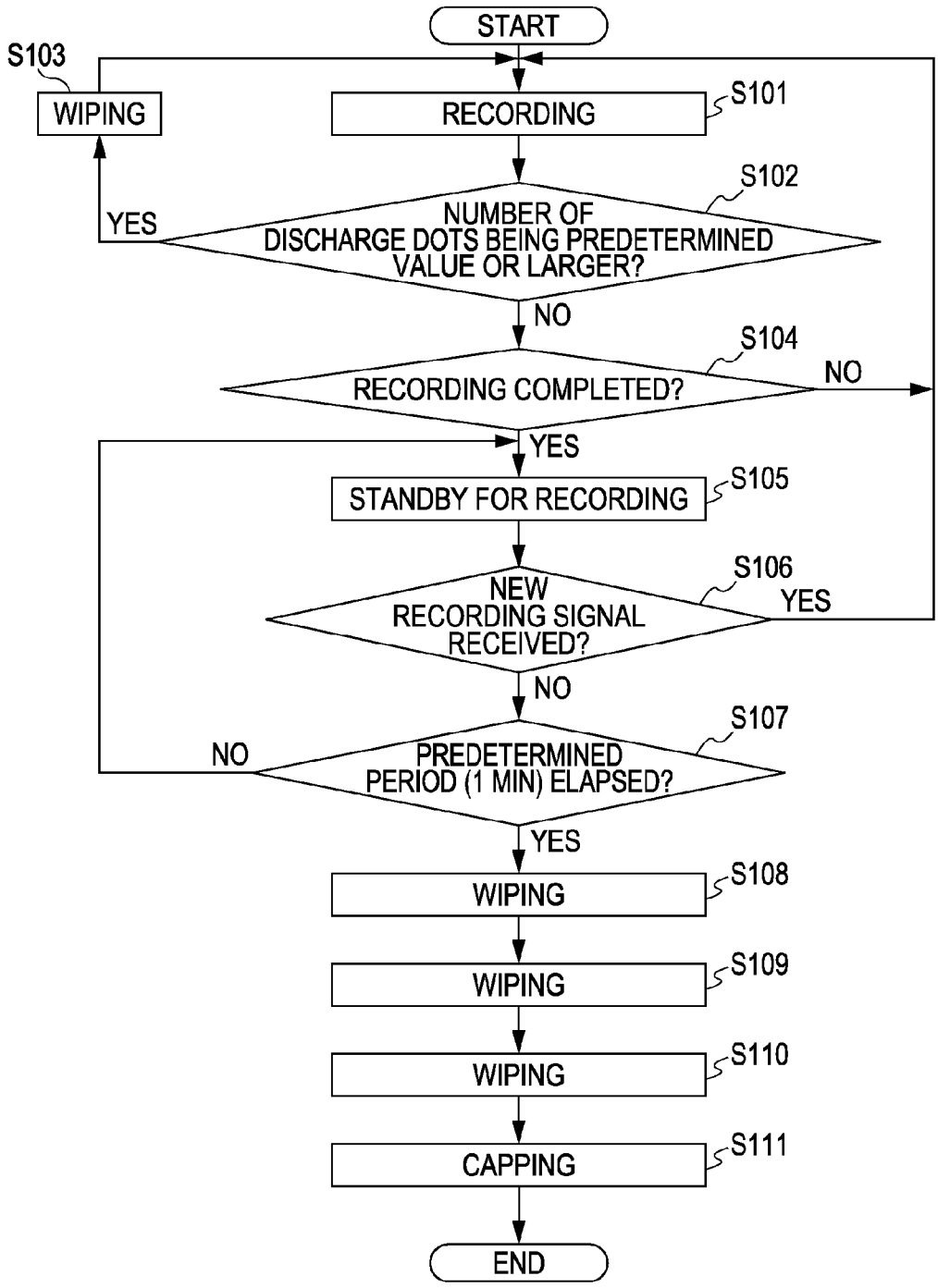
FIG. 6 is a flowchart particularly showing a maintenance operation during an intermission of a recording operation according to a second embodiment of the present invention.

FIG. 6 is a flowchart particularly showing a maintenance operation during an intermission of a recording operation according to a second embodiment of the present invention. A maintenance operation in this embodiment is suitable particularly to a user who uses a printer at a long interval, for example, once a year, and when using, the user mainly performs continuous recording. In other words, the maintenance operation does not have to take into account that recording is started again in the recording standby condition, or recording is newly started in an intermission period of the recording operation.

Operations in steps S101 to S107 in FIG. 6 are similar to the operations in steps S201 to S207 according to the first embodiment in FIG. 5. Thus, description of the similar operations are omitted.

In step S108, ink adhering to and accumulated on the discharge port surface as a result of discharging in the recording standby condition is removed by wiping similarly to step S208 in FIG. 5. After the wiping, liquid containing the ink with a high density still remains on the discharge port surface. At this time, if there is no failure found, wiping may be performed without supplement of the cleaning liquid to the blades (to perform only cleaning with the blade cleaner). With the wiping, the cleaning liquid is not supplied, and hence, the amount of the residue liquid remaining on the discharge port surface can be minimized. Accordingly, dilution efficiency can be increased in dilution operations in subsequent steps S109 to S110.

Herein, when ink of unexpected color is mixed into the nozzles through the wiping, the mixed ink is discharged. When the discharge is to be performed, a driving condition of the recording head is changed to prevent new ink from adhering to the discharge port surface through the discharge. For example, the discharge frequency (the number of discharges per one second) or the number of nozzles which discharge ink at a time may be reduced. Accordingly, a temperature increase in the recording head can be substantially restricted. Thus, discharging, which reduces satellite droplets, can be performed. Thus, the ink adhesion to the discharge port surface can be restricted.

Next, in steps S109 and S110, wiping is performed similarly to step S108, so as to dilute the liquid remaining on the discharge port surface and to prevent the liquid from being thickened. With these operations, a sufficient amount of the cleaning liquid is supplied onto the discharge port surface, so as to sufficiently dilute the remaining liquid on an entire region where the discharge ports are arranged. A sufficient dilution ratio of the liquid may be determined in accordance with, for example, a characteristic of the discharge port surface (degree of ink-shedding property), compatibility with respect to the ink, and an expected (assured) intermission period. That is, the ink component is diluted so that the ink component becomes removable although the ink component is fixed on the discharge port surface when no wiping is performed in the assured period.

In this embodiment, while the wiping is performed three times in steps S108 to S110, the number of wiping operations is not limited to three. The amount of the cleaning liquid to be applied to the blades per every wiping operation may be a proper amount. Also, when ink of unexpected color is mixed into the nozzles after the wiping, the mixed ink is discharged. Similarly to step S108, a driving condition is optimized so as to prevent new ink from adhering to the discharge port surface as a result of the discharge.

Finally, in step S111, capping is performed with the cap to prevent the inside of the discharge ports and the discharge port surface from being dried.

When an instruction signal to turn off the power of the recording apparatus is received in any of steps S101 to S111, the power of the apparatus is controlled to be turned off after the recording apparatus complete the operations to step S111, like the first embodiment.

In the dilution operation of the residue liquid on the discharge port surface, the dilution ratio of the liquid on the discharge port surface is increased as the total supplying amount of the cleaning liquid onto the discharge port surface by the wiping is increased. The dilution operation may employ a method in which the wiping is repeated as in steps S108 to S110, or a method in which the blades with a larger amount of cleaning liquid applied is used by a single wiping operation.

When the dilution progresses step by step through the plurality of wiping operations, dilution unevenness within the discharge port surface can be reduced as compared with the case where the larger amount of the cleaning liquid is supplied by a single wiping operation to provide an equivalent dilution.

Figure 7A:
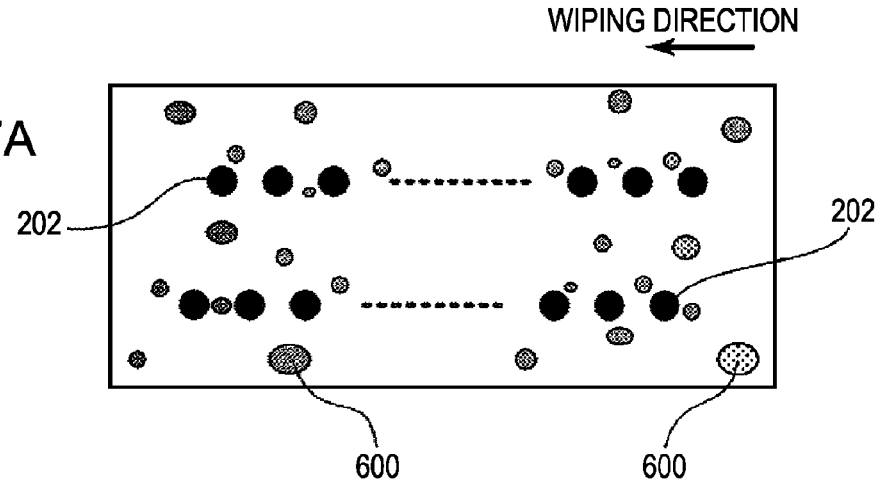
FIGS. 7A to 7C are illustrations showing a typical example of a change in density of liquid on the discharge port surface when the number of wiping operations is increased.
Figure 7B:
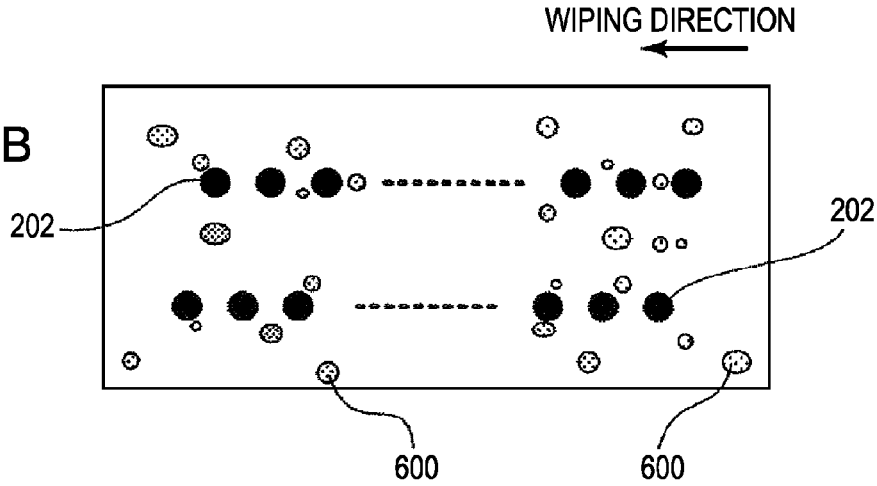
Figure 7C:
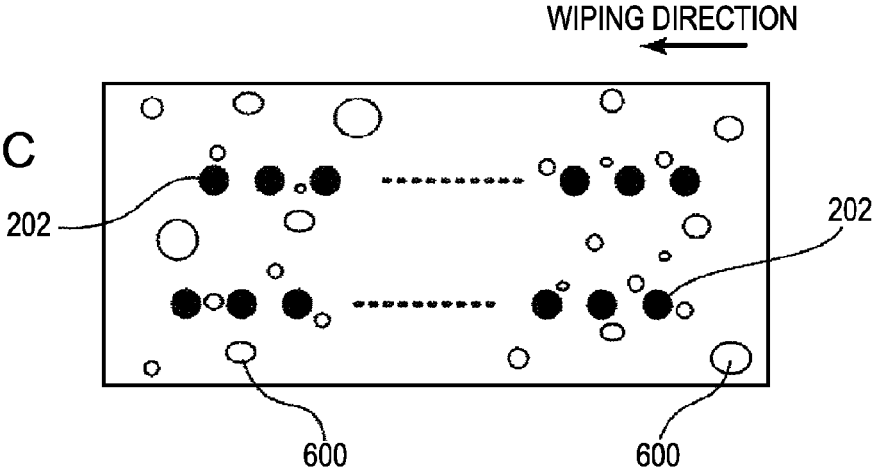

FIGS. 7A to 7C are illustrations showing a typical example of a change in density of liquid on the discharge port surface when the number of wiping operations is increased. The figures show an enlarged part of the discharge port surface of the recording head shown in FIG. 2, in which two rows of nozzles 202 arranged in parallel to a wiping direction, and residue liquid 600 adhering to the discharge port surface are illustrated.

FIG. 7A shows a condition after the first wiping operation, FIG. 7B shows a condition after the second wiping operation, and FIG. 7C shows a condition after the third wiping operation. It is found that the density of the ink contained in the residue liquid 600 on the discharge port surface is diluted every wiping, and the density distribution of the ink within the discharge port surface becomes close to a uniform state step by step.

In contrast, when the supplying amount of the cleaning liquid to the blades is increased so as to complete the dilution by a smaller number of wiping operations, a time necessary for the dilution operation can be reduced, and hence, time efficiency can be increased. Regarding this, the number of wiping operations, and the supplying amount of the cleaning liquid to the blades for every wiping operation can be determined to optimum values.

With the embodiments of the present invention, a condition can be maintained, in which ink can be reliably discharged from the recording head when the recording operation is newly started, although the wiping is not additionally performed after the wiping. Also, in any of the embodiments, the cleaning liquid can be supplied by an amount for maintaining the good discharge condition by the plurality of wiping operations. Accordingly, when the recording operation is started again or the recording operation is newly started after the several wiping operations, the amount of the cleaning liquid used in the several times of wiping is proper to the intermission period. Thus, the cleaning liquid can be prevented from being wastefully consumed.

Therefore, the consumption amount of the cleaning liquid can be reduced as much as possible when the discharge port surface of the recording head is to be cleaned up with the cleaning liquid, and the ink discharging performance can be secured for a long period.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Application No. 2007-213157 filed Aug. 17, 2007, which is hereby incorporated by reference herein in its entirety.

What is claimed is:

1. An inkjet recording apparatus configured to perform recording by discharging ink from a recording head, the apparatus comprising:

a wiping unit configured to perform wiping by bringing a blade into contact with a discharge port surface of the recording head;

a cleaning liquid applying unit configured to apply cleaning liquid to the blade, the cleaning liquid cleaning up the discharge port surface;

a capping unit configured to perform capping of the discharge port surface;

a measurement unit configured to measure an intermission period of a recording operation; and a control unit configured to control the wiping unit and the capping unit, wherein the control unit allows the capping unit to perform capping of the discharge port surface after allowing the blade to which the cleaning liquid is applied by the cleaning liquid applying unit to perform wiping of the discharge port surface when the intermission period measured by the measurement unit is a first predetermined period or longer, and allows the blade to which the cleaning liquid is applied by the cleaning liquid applying unit to perform wiping of the discharge port surface when the intermission period measured by the measurement unit is a second predetermined period or longer, wherein the second predetermined period is longer than the first predetermined period.

2. The inkjet recording apparatus according to claim 1, wherein the control unit controls the wiping unit to perform the wiping a plurality of times to supply the cleaning liquid to the discharge port surface by an amount that causes a density of an ink component to be a predetermined density or lower.

3. The inkjet recording apparatus according to claim 2, wherein at least one of the plurality of times of the wiping is performed when the intermission period is the second predetermined period or longer, each of the first predetermined period and the second predetermined period being within a period in which the ink adhering to the discharge port surface is movable and removable.

4. The inkjet recording apparatus according to claim 2, wherein at least one of the plurality of times of the wiping is performed in a first wiping mode when the intermission period is the first predetermined period or longer, and at least another of the plurality of times of the wiping is performed in a second wiping mode when the intermission period is the second predetermined period or longer, and wherein an amount of the cleaning liquid to be supplied to the discharge port surface in the second wiping mode is larger than that in the first wiping mode.

5. The inkjet recording apparatus according to claim 4, wherein the first and second wiping modes use the blade with the cleaning liquid applied.

6. The inkjet recording apparatus according to claim 4, wherein the first wiping mode uses the blade without the cleaning unit.

7. The inkjet recording apparatus according to claim 4, wherein the second wiping mode is a mode in which the wiping of the discharge port surface is repeated a plurality of times using the blade with the cleaning liquid applied.

8. The inkjet recording apparatus according to claim 4, wherein an application amount of the cleaning liquid applied every wiping in the second wiping mode is larger than that in the first wiping mode.

9. The inkjet recording apparatus according to claim 1, wherein when an instruction for interrupting power supply to the inkjet recording apparatus is present, the power supply is interrupted after a density of an ink component is reduced to a predetermined density or lower through the wiping by the wiping unit.

10. A method of controlling an inkjet recording apparatus configured to perform recording by discharging ink from a recording head, the method comprising:

disposing a wiping unit configured to perform wiping by bringing a blade into contact with a discharge port surface of the recording head;

disposing a cleaning liquid applying unit configured to apply cleaning liquid to the blade, the cleaning liquid cleaning up the discharge port surface;

disposing a capping unit configured to perform capping of the discharge port surface;

disposing a measurement unit configured to measure an intermission period of a recording operation; and controlling the wiping unit and the capping unit to allow the capping unit to perform capping of the discharge port surface after allowing the blade to which the cleaning liquid is applied by the cleaning liquid applying unit to perform wiping of the discharge port surface when the intermission period measured by the measurement unit is a first predetermined period or longer, and to allow the blade to which the cleaning liquid is applied by the cleaning liquid applying unit to perform wiping of the discharge port surface when the intermission period measured by the measurement unit is a second predetermined period or longer, wherein the second predetermined period is longer than the first predetermined period.

11. The method of controlling the inkjet recording apparatus according to claim 10, wherein the controlling step further comprises controlling the wiping unit to perform the wiping a plurality of times to supply the cleaning liquid to the discharge port surface by an amount that causes a density of an ink component to be a predetermined density or lower.

12. An inkjet recording apparatus configured to perform recording by discharging ink from a recording head, the apparatus comprising:

a wiping unit configured to perform wiping by bringing a blade into contact with a discharge port surface of the recording head;

a capping unit configured to perform capping of the discharge port surface;

a measurement unit configured to measure an intermission period of a recording operation; and a control unit configured to control the wiping unit and the capping unit, wherein the control unit allows the capping unit to perform capping of the discharge port surface after allowing the blade to perform wiping of the discharge port surface when the intermission period measured by the measurement unit is a first predetermined period or longer, and allows the blade to perform wiping of the discharge port surface when the intermission period measured by the measurement unit is a second predetermined period or longer, wherein the second predetermined period is longer than the first predetermined period.

* * * * *